US008016089B1

(12) United States Patent
McNichols

(10) Patent No.: US 8,016,089 B1
(45) Date of Patent: Sep. 13, 2011

(54) COMBINATION SUITCASE AND CHAIR APPARATUS

(76) Inventor: John P. McNichols, Scranton, PA (US)

( * ) Notice: Subject to any disclaimer, the term of this patent is extended or adjusted under 35 U.S.C. 154(b) by 146 days.

(21) Appl. No.: 12/628,456

(22) Filed: Dec. 1, 2009

(51) Int. Cl.
*A45C 9/00* (2006.01)
*A45C 5/14* (2006.01)

(52) U.S. Cl. ..... 190/8; 190/1; 190/18 R; 190/18 A; 190/39; 190/111

(58) Field of Classification Search ..... 190/1, 8, 190/11, 12 A, 18 R, 39, 111; 224/255; 297/118, 297/288.01; 312/235.2, 235.4
See application file for complete search history.

(56) References Cited

U.S. PATENT DOCUMENTS

| | | | | |
|---|---|---|---|---|
| 260,051 | A * | 6/1882 | Rigby | 190/10 |
| 786,077 | A * | 3/1905 | Wehmeier et al. | 220/520 |
| 1,038,880 | A * | 9/1912 | Hansen | 190/8 |
| 1,398,253 | A * | 11/1921 | Blando | 297/17 |
| 1,673,988 | A * | 6/1928 | Nitti | 190/8 |
| 2,705,063 | A * | 3/1955 | Torrent | 190/111 |
| 2,812,227 | A * | 11/1957 | Hill | 312/290 |
| 3,532,378 | A | 10/1970 | Dalia | |
| 4,240,662 | A * | 12/1980 | Anderson | 297/17 |
| 4,856,627 | A * | 8/1989 | Polatov | 190/11 |
| 5,374,073 | A | 12/1994 | Hung-Hsin | |
| 5,611,414 | A | 3/1997 | Walker | |
| 5,695,246 | A | 12/1997 | Tsai | |
| 5,727,844 | A * | 3/1998 | O'Quinn et al. | 297/217.1 |
| 5,957,349 | A | 9/1999 | Krulik | |
| D459,883 | S | 7/2002 | Worrell et al. | |
| 6,932,427 | B2 | 8/2005 | Tamura | |
| 2002/0063072 | A1 * | 5/2002 | Pham | 206/320 |
| 2004/0226791 | A1 * | 11/2004 | Levy | 190/11 |
| 2005/0098402 | A1 * | 5/2005 | Cohen | 190/12 A |

* cited by examiner

*Primary Examiner* — Sue Weaver
(74) *Attorney, Agent, or Firm* — Crossley Patent Law; Mark A. Crossley

(57) ABSTRACT

The combination suitcase and chair apparatus provides a suitcase typical in appearance to many others. However, somewhat hidden within the suitcase are the four legs and the section leg that provide for the apparatus to be used as a chair. The four legs telescope and provide for the first section to be the adjustable height chair bottom. The section leg pivots and telescopes from the second section such that the second section is an adjustably angled chair back. The section leg is removably covered by a flap substantially like the flaps that cover the four legs of the first section. Importantly, both the first section and second section have a removable cushioned mat. The mats provide cushioned comfort and also provide for covering the cavity within each section. The cavities are used as would be those in a typical suitcase.

4 Claims, 3 Drawing Sheets

COMBINATION SUITCASE AND CHAIR APPARATUS

BACKGROUND OF THE INVENTION

Luggage has been a commonly used item for at least hundreds of years. There come times though, when a traveler needs to rest, whether by necessity or desire. Such times might include a wait for a bus, a train, an airplane, or just a stop along the way. Carrying a chair is not convenient, especially as luggage is already being carried. Many have thus recognized that combining a luggage item with a chair is a useful endeavor. Several devices have been proposed. While each may be useful, none combine all of the most desirable traits in a suitcase that includes a chair. Some have proposed a chair that is visibly and physically available on an exterior of a suitcase, a feature that some find unappealing. Some have proposed a chair that is removably attached to a piece of luggage. Some do not elevate a user above a ground surface. The present apparatus provides the advantages wanted by most travelers who might enjoy a means of rest along their journey.

FIELD OF THE INVENTION

The combination suitcase and chair apparatus relates to luggage and more especially to a suitcase that also includes a chair that is hidden from view until used.

SUMMARY OF THE INVENTION

The general purpose of the combination suitcase and chair apparatus, described subsequently in greater detail, is to provide a combination suitcase and chair apparatus which has many novel features that result in an improved combination suitcase and chair apparatus which is not anticipated, rendered obvious, suggested, or even implied by prior art, either alone or in combination thereof.

To attain this, the combination suitcase and chair apparatus provides a suitcase typical in appearance to many others. However, substantially hidden within the suitcase are the four legs and the section leg that provide for the apparatus to be used as a chair. The four legs telescope and provide for the first section to be the adjustable height chair bottom. The section leg importantly pivots and telescopes from the second section such that the second section is an adjustably angled chair back. The section leg is removably covered by a flap substantially like the flaps that cover the four legs of the first section. Importantly, both the first section and second section have a removable cushioned mat.

The mats provide cushioned comfort and also provide for covering the cavity within each section. The cavities are used as would be those in a typical suitcase.

Thus has been broadly outlined the more important features of the improved combination suitcase and chair apparatus so that the detailed description thereof that follows may be better understood and in order that the present contribution to the art may be better appreciated.

An object of the combination suitcase and chair apparatus is to provide a suitcase.

Another object of the combination suitcase and chair apparatus is to selectively provide a chair.

A further object of the combination suitcase and chair apparatus is to provide an adjustable height chair.

An added object of the combination suitcase and chair apparatus is to provide an adjustable chair back angle.

And, an object of the combination suitcase and chair apparatus is to provide a concealable chair.

Another object of the combination suitcase and chair apparatus is to provide a cushioned chair.

Still another object of the combination suitcase and chair apparatus is to provide a rolling suitcase.

These together with additional objects, features and advantages of the improved combination suitcase and chair apparatus will be readily apparent to those of ordinary skill in the art upon reading the following detailed description of presently preferred, but nonetheless illustrative, embodiments of the improved combination suitcase and chair apparatus when taken in conjunction with the accompanying drawings.

In this respect, before explaining the current embodiments of the improved combination suitcase and chair apparatus in detail, it is to be understood that the combination suitcase and chair apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved combination suitcase and chair apparatus. It is therefore important that the claims be regarded as including such equivalent constructions insofar as they do not depart from the spirit and scope of the combination suitcase and chair apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the combination suitcase and chair apparatus generally designated by the reference number 10 will be described.

Figure 1:
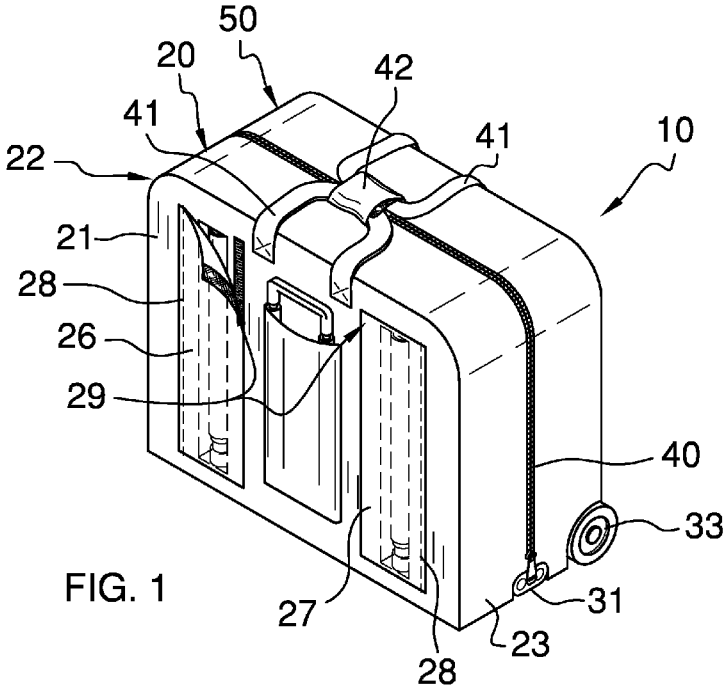
FIG. 1 is a first section oriented perspective view.
Figure 2:
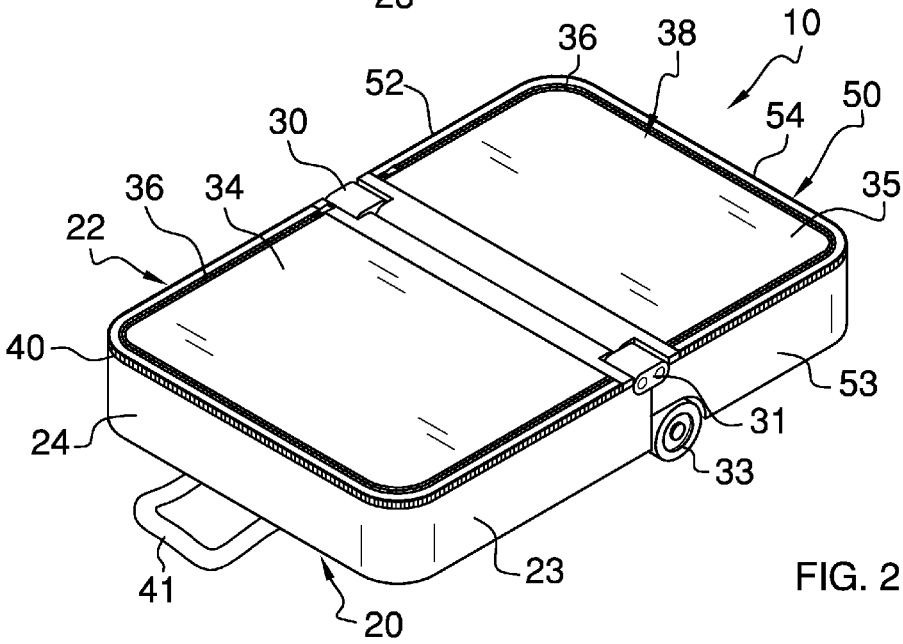
FIG. 2 is an open perspective view.

Referring to FIGS. 1 and 2, the combination suitcase and chair apparatus 10 partially comprises the first section 20 having a first wall 22 spaced apart from the second wall 23. The top 24 is spaced apart from the bottom 25.

Figure 5:
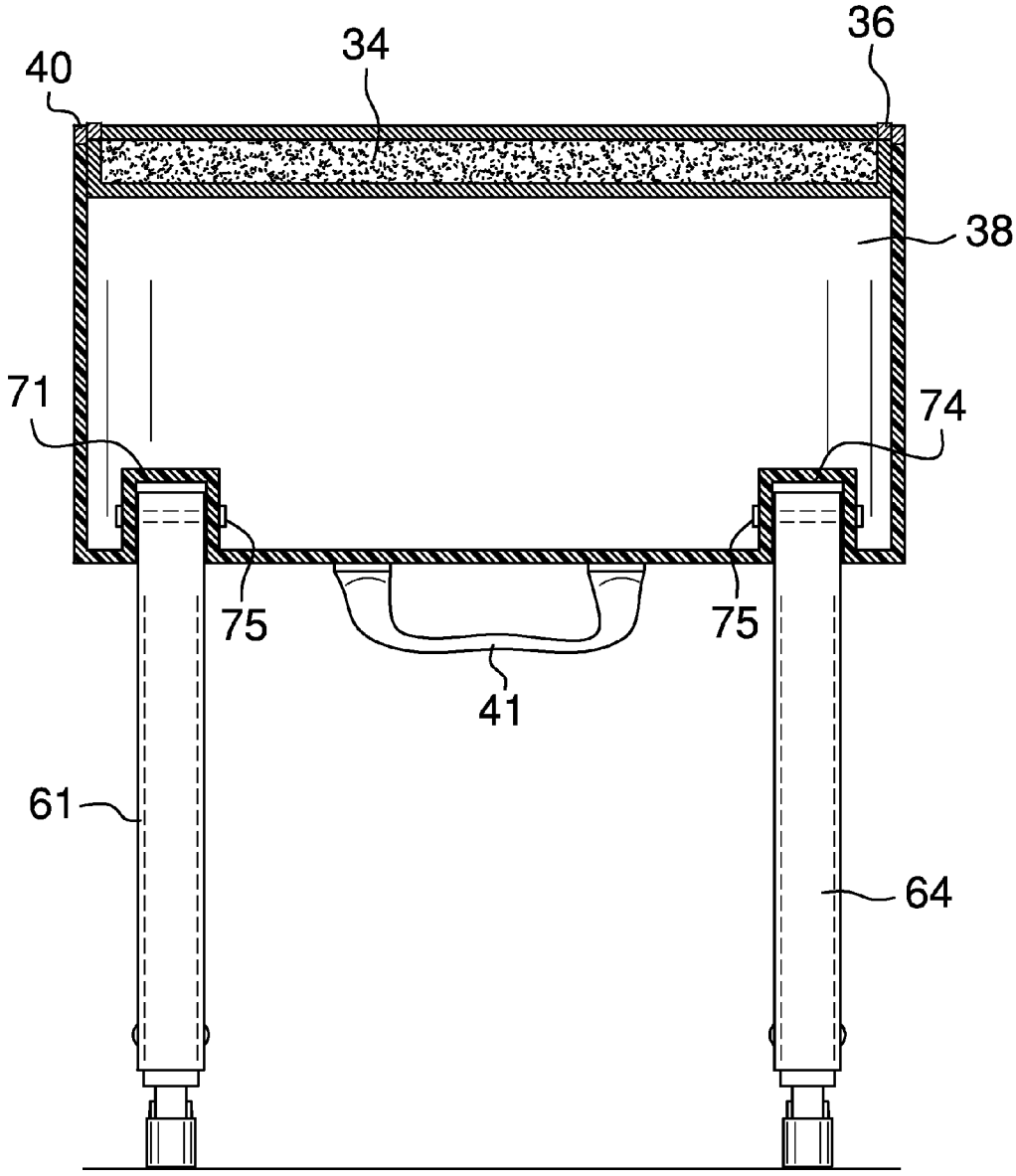
FIG. 5 is a partial cross sectional view of FIG. 4, taken along the line 5-5.

Continuing to refer to FIG. 1 and referring also to FIG. 5, the exterior wall 21 exteriorly covers the cavity 38 within. The cavities 38 of both the first section 20 and the second section 50 are substantially identical.

Figure 3:
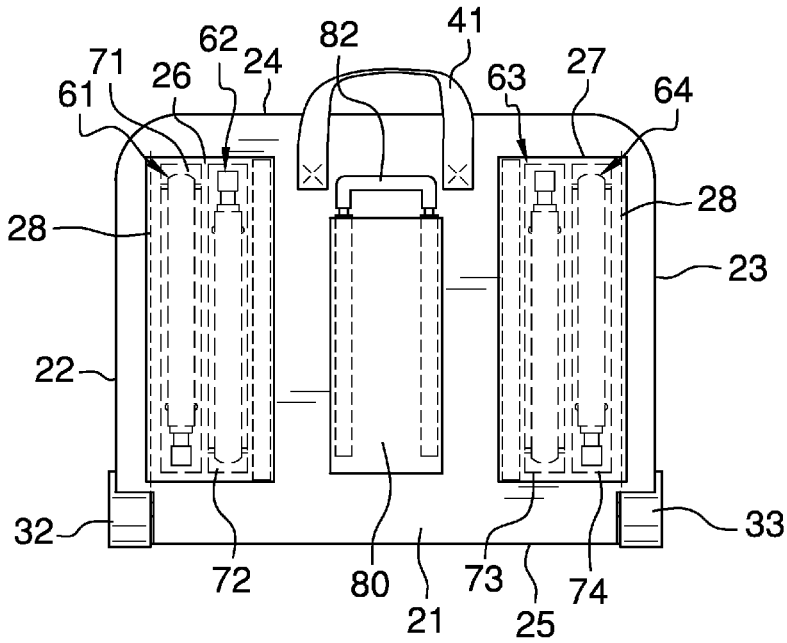
FIG. 3 is a first section elevation view.
Figure 4:
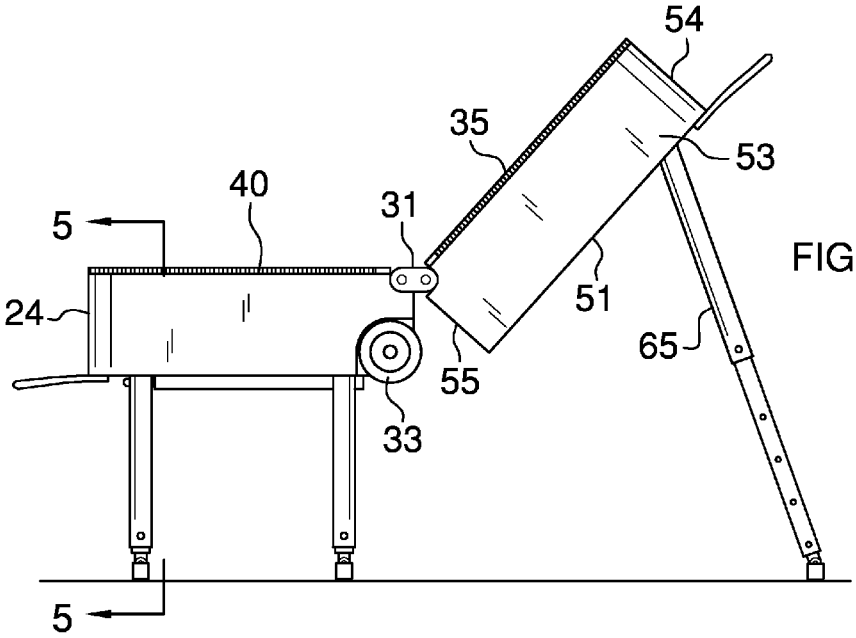
FIG. 4 is a lateral elevation view with legs and section leg extended.

Referring to FIGS. 3 and 4, a pair of identical adjacent leg slots is disposed in the first section 20 exterior wall 21. The leg slots are disposed longitudinally between the top 24 and the bottom 25 and are proximal to the first wall 22. These described leg slots comprise the first leg slot 71 adjacent to the second leg slot 72. The first leg 61 is pivotally disposed within the first leg slot 71. The first leg 61 is pivoted outwardly toward the top 24. The second leg 62 is pivotally disposed within the second leg slot 72.

The second leg 62 is pivoted outwardly toward the bottom 25. The first flap 26 removably covers the first leg slot 71 and second leg slot 72. The stitch line 28 is laterally disposed on the first flap 26 for first flap 26 retention. Hook and loop 29 is medially disposed on the first flap 26 so that the first flap 26 may be peeled away from the exterior wall 21 for leg access. Another pair of identical adjacent leg slots is disposed in the first section 20 exterior wall 21. These leg slots are disposed longitudinally between the top 24 and the bottom 25 and proximal to the second wall 23. These leg slots comprise the third leg slot adjacent to the more laterally disposed fourth leg slot 74. The third leg 63 is pivotally disposed within the third leg slot 73. The third leg 63 is pivoted outwardly toward the bottom 25. The fourth leg 64 is pivotally disposed within the fourth leg slot 74. The fourth leg 64 is pivoted outwardly toward the top 24. Each of the four legs is affixed within the leg slots and pivoted by a leg pivot 75. The second flap 27 removably covers the third leg slot 73 and fourth leg slot 74. A stitch line 28 is laterally disposed on the second flap 27. Hook and loop 29 is medially disposed on the second flap 27 and provides access to the third leg 63 and fourth leg 64.

Referring again to FIGS. 1 and 3, the center flap 80 is disposed between the first flap 26 and the second flap 27. The telescopic handle 82 is disposed within the center flap 80. A handle strap 41 is disposed upwardly from the first section 20 exterior wall 21. The cushioned first mat 34 removably covers the first section 20 cavity 38 via the mat zipper 36.

Referring again to FIGS. 1, 2, and 4, the second section 50 has a section first wall 52 spaced apart from a section second wall 53. The second section 50 further comprises the section top 54 spaced apart from the section bottom 55. The section exterior wall 51 covers the cavity 38 within. The cushioned second mat 35 removably covers the second section 50 cavity 38. The section leg 65 is concealably and pivotally disposed within the section exterior wall 51. A handle strap 41 is disposed upwardly from the section exterior wall 51. The pair of spaced apart laterally disposed hinges comprising the first hinge 30 and the second hinge 31 joins the first section 20 to the second section 50. The pair of identical spaced apart wheels comprise the first wheel 32 disposed at the section bottom 55 and section first wall 52 of the second section 50. The second wheel 33 is disposed at the section bottom 55 and the section second wall 53 of the second section 50. The wheels importantly provide ease in transport of the apparatus 10.

With respect to the above description then, it is to be realized that the optimum dimensional relationships for the parts of the combination suitcase and chair apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the combination suitcase and chair apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the combination suitcase and chair apparatus may be used.

Therefore, the foregoing is considered as illustrative only of the principles of the combination suitcase and chair apparatus. Further, since numerous modifications and changes will readily occur to those skilled in the art, it is not desired to limit the combination suitcase and chair apparatus to the exact construction and operation shown and described, and accordingly, all suitable modifications and equivalents may be resorted to, falling within the scope of the combination suitcase and chair apparatus.

What is claimed is:

1. A combination suitcase and chair apparatus comprising, in combination:

a first section having a first wall spaced apart from a second wall, a top spaced apart from a bottom, an exterior wall, and a cavity within;

a pair of identical adjacent leg slots disposed in the first section exterior wall, the leg slots disposed longitudinally between the top and the bottom and proximal to the first wall, the leg slots comprising a first leg slot adjacent to a second leg slot;

a first leg pivotally disposed within the first leg slot, the first leg pivoted outwardly toward the top;

a second leg pivotally disposed within the second leg slot, the second leg pivoted outwardly toward the bottom;

a first flap removably covering the first and second leg slots;

a stitch line laterally disposed on the first flap;

a hook and loop medially disposed on the first flap;

a pair of identical adjacent leg slots disposed in the first section exterior wall, the leg slots disposed longitudinally between the top and the bottom and proximal to the second wall, the leg slots comprising a third leg slot adjacent to a fourth leg slot;

a third leg pivotally disposed within the third leg slot, the third leg pivoted outwardly toward the bottom;

a fourth leg pivotally disposed within the fourth leg slot, the fourth leg pivoted outwardly toward the top;

a second flap removably covering the third and fourth leg slots;

a stitch line laterally disposed on the second flap;

a hook and loop medially disposed on the second flap;

a center flap disposed between the first flap and the second flap;

a telescopic handle disposed within the center flap;

a handle strap disposed upwardly from the first section exterior wall;

a cushioned first mat removably covering the first section cavity;

a second section having section first wall spaced apart from a section second wall, a section top spaced apart from a section bottom, a section exterior wall, and a cavity within;

a cushioned second mat removably covering the second section cavity;

a section leg concealably and pivotally disposed within the section exterior wall;

a handle strap disposed upwardly from the section exterior wall;

a pair of spaced apart laterally disposed hinges joining the first section to the second section.

2. The apparatus according to claim 1 further comprising a handle band removably joining the handle straps of the first section and the second section.

3. A combination suitcase and chair apparatus comprising, in combination:

a first section having a first wall spaced apart from a second wall, a top spaced apart from a bottom, an exterior wall, and a cavity within;

a pair of identical adjacent leg slots disposed in the first section exterior wall, the leg slots disposed longitudinally between the top and the bottom and proximal to the first wall, the leg slots comprising a first leg slot adjacent to a second leg slot;

a first telescopic leg pivotally disposed within the first leg slot, the first leg pivoted outwardly toward the top;

a second telescopic leg pivotally disposed within the second leg slot, the second leg pivoted outwardly toward the bottom;

a first flap removably covering the first and second leg slots;

a stitch line laterally disposed on the first flap;

a hook and loop medially disposed on the first flap;

a pair of identical adjacent leg slots disposed in the first section exterior wall, the leg slots disposed longitudinally between the top and the bottom and proximal to the second wall, the leg slots comprising a third leg slot adjacent to a fourth leg slot;

a third telescopic leg pivotally disposed within the third leg slot, the third leg pivoted outwardly toward the bottom;

a fourth telescopic leg pivotally disposed within the fourth leg slot, the fourth leg pivoted outwardly toward the top;

a second flap removably covering the third and fourth leg slots;

a stitch line laterally disposed on the second flap;

a hook and loop medially disposed on the second flap;

a center flap disposed between the first flap and the second flap;

a telescopic handle disposed within the center flap;

a handle strap disposed upwardly from the first section exterior wall;

a cushioned first mat removably covering the first section cavity;

a second section having section first wall spaced apart from a section second wall, a section top spaced apart from a section bottom, a section exterior wall, and a cavity within;

a cushioned second mat removably covering the second section cavity;

a telescopic section leg concealably and pivotally disposed within the section exterior wall;

a handle strap disposed upwardly from the section exterior wall;

a pair of spaced apart laterally disposed hinges joining the first section to the second section.

4. A combination suitcase and chair apparatus comprising, in combination:

a first section having a first wall spaced apart from a second wall, a top spaced apart from a bottom, an exterior wall, and a cavity within;

a pair of identical adjacent leg slots disposed in the first section exterior wall, the leg slots disposed longitudinally between the top and the bottom and proximal to the first wall, the leg slots comprising a first leg slot adjacent to a second leg slot;

a first telescopic leg pivotally disposed within the first leg slot, the first leg pivoted outwardly toward the top;

a second telescopic leg pivotally disposed within the second leg slot, the second leg pivoted outwardly toward the bottom;

a first flap removably covering the first and second leg slots;

a stitch line laterally disposed on the first flap;

a hook and loop medially disposed on the first flap;

a pair of identical adjacent leg slots disposed in the first section exterior wall, the leg slots disposed longitudinally between the top and the bottom and proximal to the second wall, the leg slots comprising a third leg slot adjacent to a fourth leg slot;

a third telescopic leg pivotally disposed within the third leg slot, the third leg pivoted outwardly toward the bottom;

a fourth telescopic leg pivotally disposed within the fourth leg slot, the fourth leg pivoted outwardly toward the top;

a second flap removably covering the third and fourth leg slots;

a stitch line laterally disposed on the second flap;

a hook and loop medially disposed on the second flap;

a center flap disposed between the first flap and the second flap;

a telescopic handle disposed within the center flap;

a handle strap disposed upwardly from the first section exterior wall;

a cushioned first mat removably covering the first section cavity;

a second section having section first wall spaced apart from a section second wall, a section top spaced apart from a section bottom, a section exterior wall, and a cavity within;

a cushioned second mat removably covering the second section cavity;

a telescopic section leg concealably and pivotally disposed within the section exterior wall;

a handle strap disposed upwardly from the section exterior wall;

a pair of spaced apart laterally disposed hinges joining the first section to the second section, a pair of identical spaced apart wheels comprising a first wheel disposed at the section bottom and section first wall, a second wheel disposed at the section bottom and the section second wall.

* * * * *